United States Patent [19]

Kane

[11] Patent Number: 5,026,066

[45] Date of Patent: Jun. 25, 1991

[54] PRACTICE PUTTING GUIDE

[76] Inventor: John F. Kane, P.O. Box 1149, East Dennis, Mass. 02641

[21] Appl. No.: 592,224

[22] Filed: Oct. 3, 1990

[51] Int. Cl.[5] ..... A63B 69/36

[52] U.S. Cl. ..... 273/192; 273/194 R

[58] Field of Search ..... 273/183 B, 191 R, 191 A, 273/191 B, 192, 188 R, 189 R, 186 A, 194 R

[56] References Cited

U.S. PATENT DOCUMENTS

| | | | |
|---|---|---|---|
| 2,776,836 | 1/1957 | Zadina | 273/192 |
| 3,190,658 | 6/1965 | Kane | 273/192 |
| 4,437,669 | 3/1984 | Pelz | 273/192 |

*Primary Examiner*—George J. Marlo

*Attorney, Agent, or Firm*—Samuels, Gauthier & Stevens

[57] ABSTRACT

A putting guide for use in improving a golfer's stroke during practice putting. The guide has a forwardly facing flat surface and a pair of rearwardly extending mutually spaced leg engaging members suitably contoured to be held between a golfer's legs. The leg engaging members are mounted between a pair of parallel tracks on the rear of the forwardly facing flat surface, and the spacing between the leg engaging members may be varied by moving same along the length of the parallel tracks. An adjustable length guide clamp has one end for attachment to the shaft of a putter and the other end for sliding movement along the forwardly facing flat surface of the guide member.

3 Claims, 1 Drawing Sheet

PRACTICE PUTTING GUIDE

BACKGROUND OF THE INVENTION

1. Field of the Invention

This invention relates generally to sports equipment, and is concerned in particular with an improvement in putting guides used to assist golfers in improving their putting strokes.

2. Description of the Invention

A prior art putting guide is disclosed in my U.S. Pat. No. 3,190,658, the description of which is herein incorporated by reference in its entirety. While this guide is entirely suitable for its intended purposes, it does have several drawbacks. For example, the spacing between the rearwardly protruding leg engaging members is not adjustable. Nor is the length of the guide clamp adjustable. This lack of adjustability limits the adaptability of the guide to comfortable use by golfers who differ markedly in size, shape, etc.

SUMMARY OF THE INVENTION

The objective of the present invention is to improve the adaptability of the prior art putting guide to use by all golfers, regardless of their size or shape. To this end, the prior art putting guide has been modified by the introduction of means to accommodate changes in the spacing between the leg engaging members as well as changes in the length of the guide clamp. This provides the golfer with the needed flexibility to adapt the guide to his particular body dimensions, stance, etc.

DETAILED DESCRIPTION OF THE INVENTION

Figure 1:
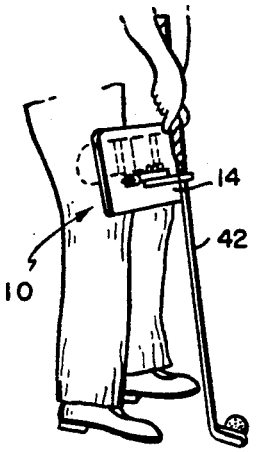
FIG. 1 is a perspective view illustrating the use of the putting guide of present invention by a golfer.
Figure 2:
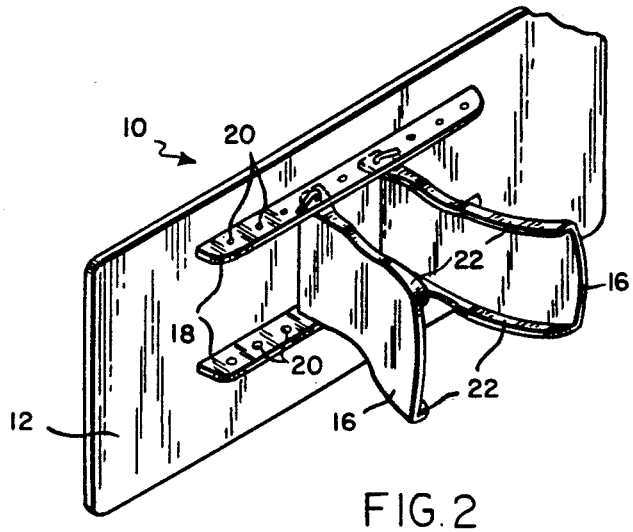
FIG. 2 is a rear perspective view of the guide member.

Referring now to the drawings, a guide member is generally indicated at 10. The guide member includes a generally rectangular plate 12 having a forwardly facing flat surface 14 and a pair rearwardly extending mutually spaced leg engaging members 16. The leg engaging members are suitably contoured to be held between a golfer's legs.

The leg engaging members are mounted at the rear face of the plate 12 by means of a pair of parallel tracks 18, each having spaced holes indicated typically at 20 extending therethrough. The holes 20 in both tracks 18 are mutually aligned to provide a series of sets spaced one from the other in the direction of the track lengths.

The leg engaging members 16 have upper and lower inwardly disposed flanges 22 which have apertures 24 extending therethrough through. The flange apertures 24 of each leg engaging members 16 are alignable with one of the various sets of aligned holes 20 in the tracks 18 to thereby receive locating pins 26. It will thus be seen that by simply removing the pins 26, the leg engaging members 22 can be shifted towards or away from one another into alignment with selected sets of holes 20, after which the pins 26 can be reinserted. Thus, the spacing between the leg engaging members 16 can be modified to suit the requirements of any particular golfer.

Figure 3:
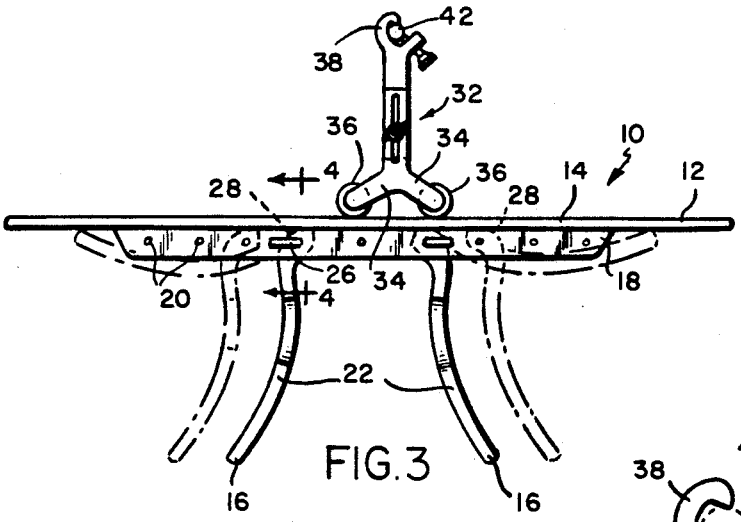
FIG. 3 is a top plan view of the guide member and clamp.
Figure 4:
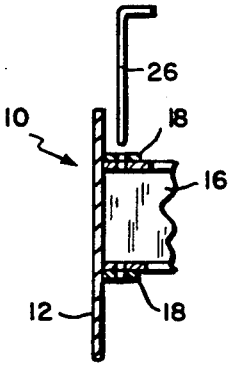
FIG. 4 is a sectional view taken along line 4—4 of FIG. 3.
Figure 5:
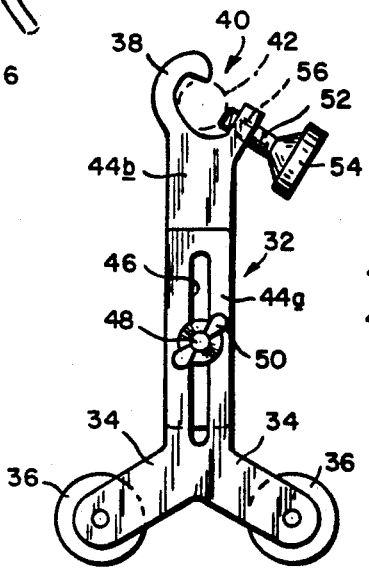
FIG. 5 is a top plan view of the guide clamp.
Figure 6:
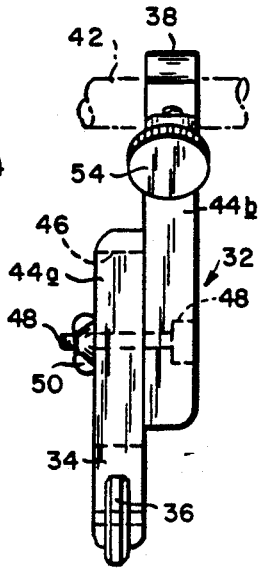
FIG. 6 is a side view of the guide clamp.

As with the prior art guide, each leg engaging member is provided with a cam surface 28 adapted to coact with the rear face of the plate 12 to resist forces exerted by the golfer's legs tending to press the leg engaging members together. With this arrangement, the leg engaging members may be pivoted to storage positions lying against the plate 12 as indicated by the broken in FIG. 3.

A guide clamp generally indicated at 32 has a base portion with angularly extending feet 34 carrying rollers 36, and a head portion 38 defining an opening 40 sized to receive the shaft 42 of a putter. An intermediate body section made up of overlapping segments **44*a*, 44*b* connects the base portion to the head portion 38. The overlapping segments are slotted as at 46 to accommodate a transverse bolt 48 to which is threaded a wing nut 50. A screw 52 having an enlarged head 54 is threaded through the head portion 38 as at 56**.

In use, a putter shaft 42 is received in the opening 40 in head portion 38, after which the screw 52 is tightened to fix the guide clamp 32 at the desired location along the shaft length. Thereafter, the wing nut 50 is loosened and the overlapping segments **44*a*, 44*b* of the clamp are adjusted in relation to each other in order to suit the requirements of the golfer. Thereafter, the wing nut 50 is tightened and the guide clamp is ready for use with the guide member 10** as described in my prior patent.

In light of the foregoing it will now be understood that by appropriately adjusting the spacing between the leg engaging members 16, and if necessary by also adjusting the overall length of the guide clamp 32, the size and stance of each golfer can be accommodated, thereby maximizing the effectiveness of the putting guide.

I claim:

1. A putting guide for use in improving a golfer's stroke during practice putting, said guide comprising in combination: a guide member having a forwardly facing flat surface and a pair of rearwardly extending mutually spaced leg engaging members suitably contoured to be held between a golfer's legs; mounting means for adjustably positioning said leg engaging members to vary the spacing therebetween; a guide clamp separate from and freely moveable relative to said guide member, means for removably mounting said guide clamp in a radially extending fashion on the shaft of a putter with one end of said clamp disposed laterally from the longitudinal axis of said shaft, whereby said guide member may be held between a golfer's legs with said forwardly facing flat surface aligned with the cup and, the putter having said guide clamp attached thereto swung by said golfer in a controlled swing by maintaining the laterally disposed end of said guide clamp in constant contact with the flat surface of said guide member.

2. The putting guide of claim 1 wherein said mounting means comprises a pair of parallel tracks between which said leg engaging members are positioned, said leg engaging members having apertures and said tracks respectively having spaced sets of mutually aligned holes extending therethrough, and pin members insertable through the apertures in said leg engaging members and respective sets of said mutually aligned holes in said tracks.

3. The putting guide of claim 1 further comprising means for adjusting the length of said guide clamp.

* * * * *